US005244400A

United States Patent [19]

Hatagishi

[11] Patent Number: 5,244,400

[45] Date of Patent: Sep. 14, 1993

[54] ELECTRICAL CONNECTOR WITH FASTENING CAM MEMBER

[75] Inventor: Yuji Hatagishi, Shizuoka, Japan

[73] Assignee: Yazaki Corporation, Tokyo, Japan

[21] Appl. No.: 777,919

[22] Filed: Oct. 17, 1991

[30] Foreign Application Priority Data

Oct. 22, 1990 [JP] Japan ..... 2-281966

[51] Int. Cl.[5] ..... H01R 13/62

[52] U.S. Cl. ..... 439/157; 439/489

[58] Field of Search ..... 439/310, 325, 347, 489, 439/152, 153, 157, 488, 154–156

[56] References Cited

U.S. PATENT DOCUMENTS

| | | | |
|---|---|---|---|
| 3,453,586 | 7/1969 | Brendlen, Jr. | 339/45 |
| 4,586,771 | 5/1986 | Kraemer et al. | 439/310 |
| 4,875,873 | 10/1989 | Ishizuka et al. | 439/347 |
| 4,902,240 | 2/1990 | Kuzuno et al. | 439/310 |
| 4,902,244 | 2/1990 | Endo et al. | 439/489 |

FOREIGN PATENT DOCUMENTS 61-203581 9/1986 Japan .

OTHER PUBLICATIONS

Official Gazette, May 6, 1986, pp. 220 and 221.

*Primary Examiner*—Larry I. Schwartz
*Assistant Examiner*—Hien D. Vu
*Attorney, Agent, or Firm*—Sughrue, Mion, Zinn, Macpeak & Seas

[57] ABSTRACT

An electrical connector comprises: a male housing; a female housing in which said male housing is movably fitted; a cam member movably fitted on the female housing so that the cam member can be moved across the direction mutual fastening of both the housing in order to fasten them each other; and detecting member for detecting whether both the housings are completely fastened to each other or not, the detecting member being provided to both the cam member and the female housing.

3 Claims, 4 Drawing Sheets

ELECTRICAL CONNECTOR WITH FASTENING CAM MEMBER

BACKGROUND OF THE INVENTION

The present invention relates to an electrical connector which is for electrically connecting the wires of a motor vehicle in the main to each other and whose pair of housings are fastened to and unfastened from each other by operation a cam member.

FIG. 4 shows a conventional electrical connector disclosed in the Japan patent Application (OPI) No. 203581/86 (the term "OPI" as used herein means an "unexamined published application") and including a female housing a, a male housing b, and a double-armed cam member c for fastening the housings to each other. Metal terminals are accommodated in each of the housings a and b. The box-shaped portion $a_1$ of the female housing a has slender openings $a_2$ for sliding and guiding the cam member c. Operating projections $c_1$ are provided on the mutually-opposite inner surfaces of the cam member c so as to be engaged in the slender openings $a_2$ and extend into the box-shaped portion $a_1$. The mutually-opposite outer surfaces of the male housing b have inlet grooves $b_1$, into which the operating projections $c_1$ are moved, and oblique operated grooves $b_2$ continuous to the inlet grooves. When the female and the male housings a and b are to be fastened to each other with the cam member c, the cam member is fitted on the female housing and the male housing is positioned in front of the male housing so that the inlet grooves $b_1$ of the male housing are opposed to the operating projections $c_1$ of the cam member, as shown in FIG. 5(*a*). The male housing b is then pushed into the female housing a so that the operating projections $c_1$ are moved to the outer ends of the oblique operated grooves $b_2$ through the inlet grooves $b_1$, as shown in FIG. 5(*b*). The cam member c is then moved rightward with regard to the drawings so that the operating projections $c_1$ are moved from the outer ends of the oblique operated grooves $b_1$ to the inner ends thereof through the grooves to pull the male housing b deeper into the female housing a, as shown in FIG. 5(*c*). The housings a and b are thus fastened to each other with the cam member c to electrically connect the metal terminals to each other. In this conventional art, if the operating projections $c_1$ of the cam member c fail to be moved from the outer ends of the oblique operated grooves $b_1$ of the male housing b to the inner ends of the grooves through them but stop halfway therein, the female and the male housings a and b are incompletely fastened to each other. The incomplete fastening cannot be easily detected. This is a problem.

SUMMARY OF THE INVENTION

The present invention was made in order to solve the problem mentioned above. Accordingly, it is an object of the invention to provide such an electrical connector that it can be securely and easily detected whether the male and female housings of the connector are completely fastened to each other with a cam member or not.

An electrical connector comprises: a male housing; a female housing in which said male housing is movably fitted; a cam member movably fitted on the female housing so that the cam member can be moved across the direction mutual fastening of both the housing in order to fasten them each other; and detecting member for detecting whether both the housings are completely fastened to each other or not, the detecting member being provided to both the cam member and the female housing.

DETAILED DESCRIPTION OF EXEMPLARY EMBODIMENT

An embodiment of the present invention is hereafter described in detail with reference to the drawings attached hereto.

Figure 1:
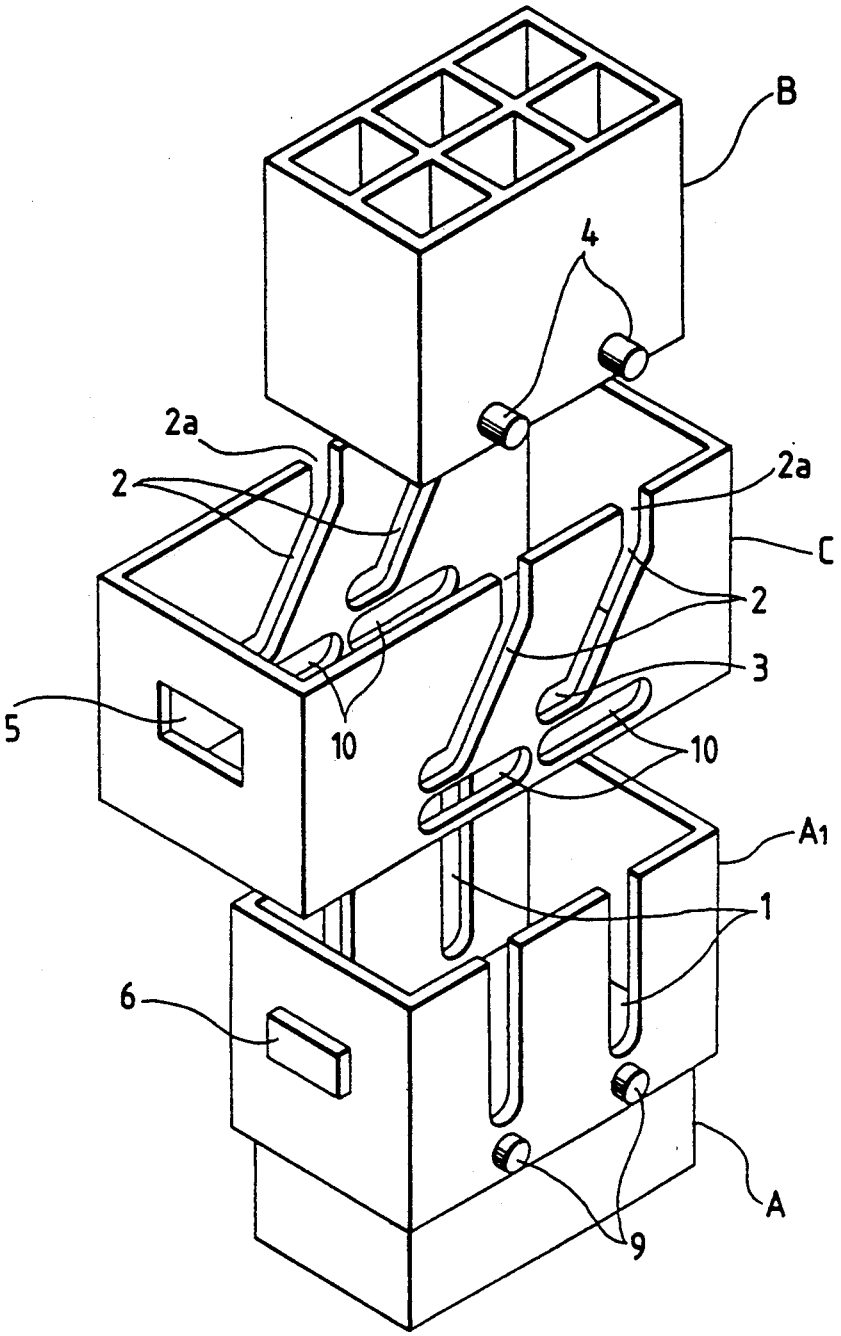
FIG. 1 is a perspective exploded view of an electrical connector which is an embodiment of the present invention.

FIG. 1 shows an embodiment of an electrical connector which comprises a female housing A, a male housing B and a frame-shaped cam member C for fastening both the housings to each other. Metal terminals (not shown) are accommodated in each of the housings A and B. The box-shaped portion $A_1$ of the female housing A has sliding guide slits 1 in the mutually opposing side walls in such a manner that the slits extend from the top edge toward the opposite lower edge thereof. The box-shaped portion $A_1$ also has projections 9 on the outer surfaces of the mutually opposing side walls and a jut 6 on the outer surface of another side wall. The jut 6 is for detecting whether the housings A and B are completely fastened to each other or not. The male housing B has operated projections 4 on the outer surfaces of the mutually opposing side walls of the housing. The cam member C has inlet openings 2*a*oblique operating openings 2, engagement openings 3 and sliding guide slots 10 in the mutually opposite side walls of the cam member, and an opening 5 in another side wall of the member. The opening 5 is for detecting whether or not the housings A and B are completely fastened to each other. The inlet openings 2*a* are provided at the top edges of the side walls of the cam member C. The oblique operating openings 2 extend continuously from the inlet openings 2*a* to the engagement openings 3. The engagement openings 3 extend across or traverse to the direction of the fastening of the housings A and B.

Figure 2A:
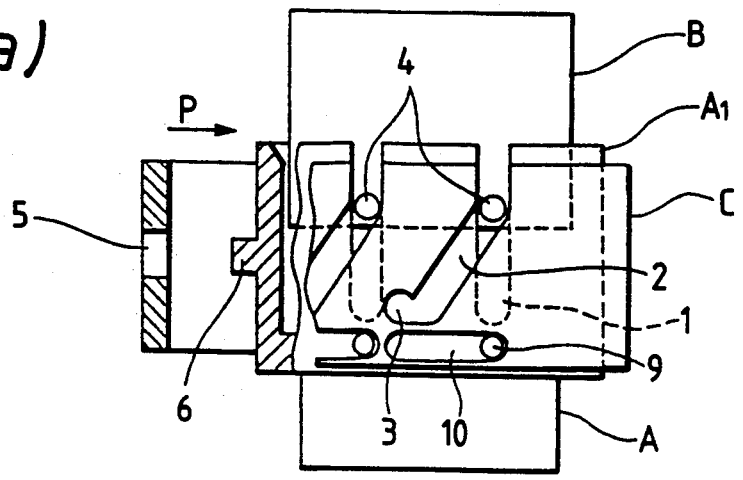
FIGS. 2(*a*), 2(*b*) and 2(*c*) are cutaway plan views of the connector to illustrate the steps of fastening of the male and female housings thereof.
Figure 2B:
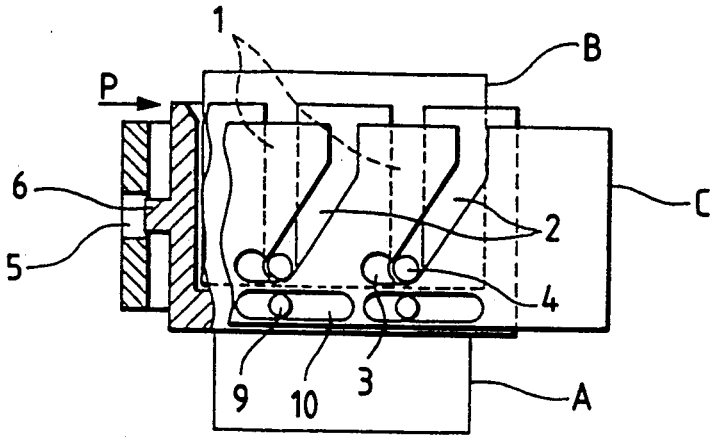
Figure 2C:
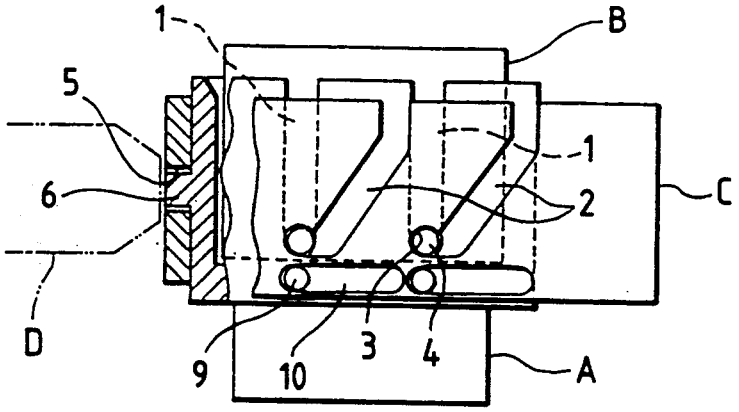

When the female and the male housings A and B and the cam member C are assembled together, the male housing is fitted in the female housing and the cam member is fitted on the female housing in such a manner that the operated projections 4 of the male housing extend through the sliding guide slits 1 of the female housing and are located at the outer ends of the oblique operating openings 2 of the cam member, and the projections 9 of the female housing are fitted in the sliding guide slots 10 of the cam member, as shown in FIG. 2(*a*). When the housings A and B are then to be fastened to each other with the cam member C, the cam member is pushed in a direction P so that the operated projections 4 of the male housing are moved in the oblique operating openings 2 of the cam member and the sliding guide slits 1 of the female housing, the male housing is pulled deepther into the box-shaped portion $A_1$ of the female housing, and the detecting opening 5 of the cam member is moved toward the detecting jut 6 of the female housing, as shown in FIG. 2(*b*). The cam member C is then pushed further in the direction P so that the operated projections 4 of the male housing B are locked in the engagement openings 3 of the cam member, and the detecting jut 6 of the female housing A is located in the detecting opening 5 to make the outer surface of the jut and that of the cam member flush with each other, as shown in FIG. 2(*c*). The female and the male housings A and B are thus fastened to each other with the cam C. The outer surface of the jut 6 and that of the side wall of the cam member C, which has the opening 5, are flush with other when the housings A and B are completely each other. For that reason, whether the housings A and B are completely fastened to each other or not can be inspected if a photosensor D is put on the outer surface of the portion of the cam member C to check on flatness.

Figure 3:
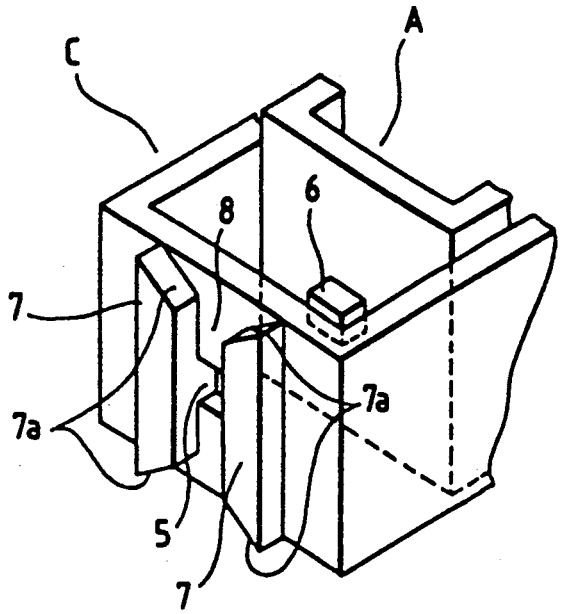
FIG. 3 is a perspective view of a major part of an electrical connector which is a modification of the embodiment.
Figure 4:
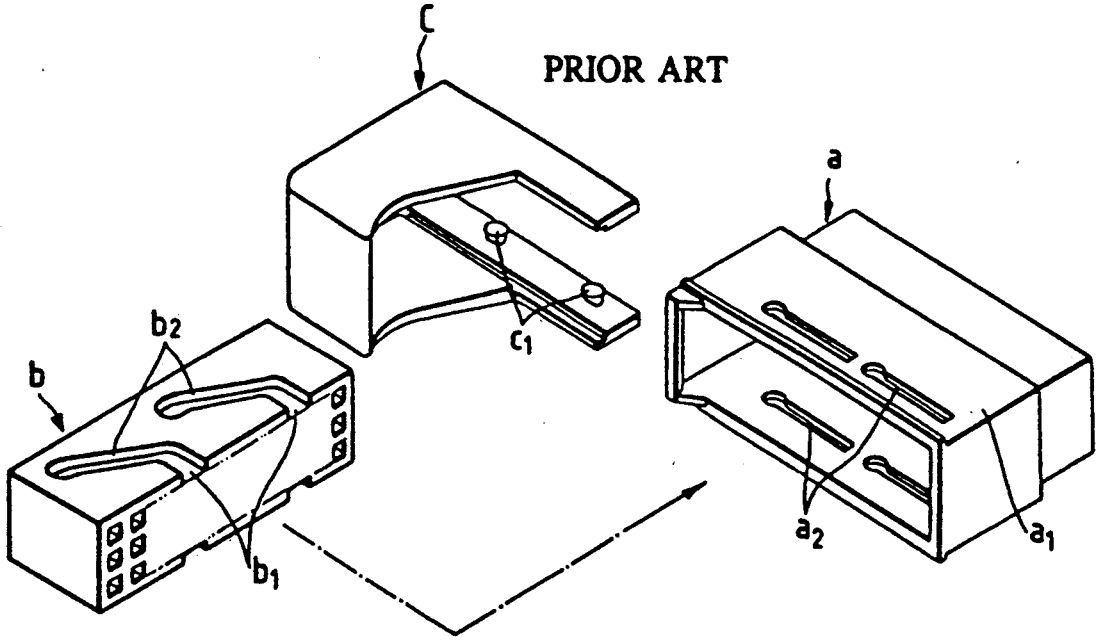
FIG. 4 is a perspective exploded view of a conventional electrical connector.
Figure 5A:
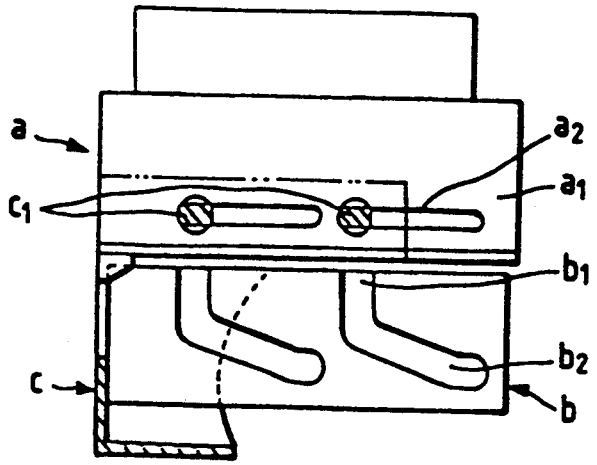
FIG. 5(a) PRIOR ART
FIGS. 5(*a*), 5(*b*) and 5(*c*) are cutaway plan views of the conventional connector to illustrate the steps of fastening of the male and female housings thereof.
Figure 5B:
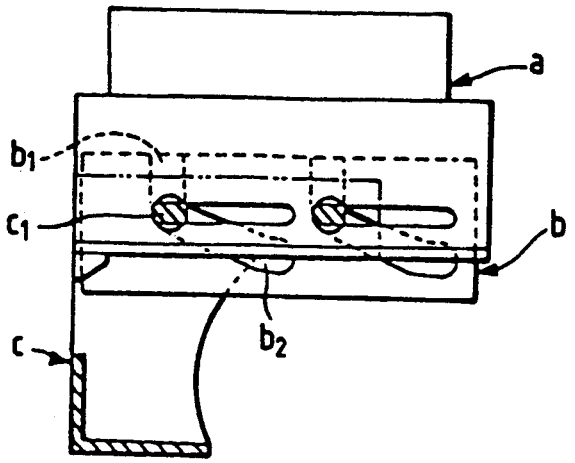
FIG. 5(b) PRIOR ART
Figure 5C:
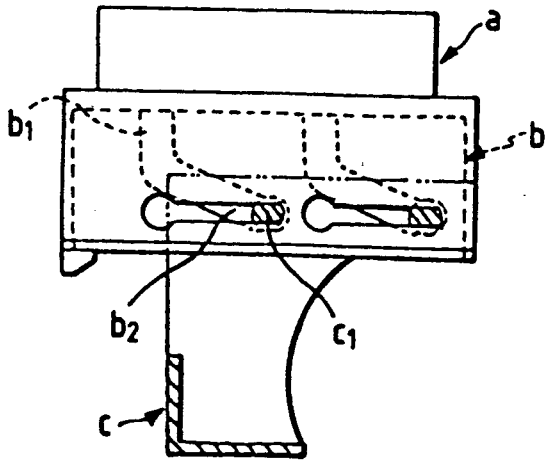
FIG. 5(c) PRIOR ART

FIG. 3 shows a major part of an electrical connector which is a modification of the embodiment. In the connector shown in FIG. 3, guide juts 7 having oblique guide surfaces 7*a* at both the ends of the juts are provided on the outer surface of a fastening cam member C at both the ends of the detecting opening 5 of the cam member in such a manner that the oblique guide surfaces obliquely face each other, and a groove 8 for positioning an inspection means such as a photosensor is defined between the guide juts. The inspection means can be easily guided into the positioning groove 8 by the oblique guide surfaces 7*a* to perform inspection in a prescribed position. For that reason, it can be quickly and easily inspected at a time whether the outer surface of the detecting jut 6 of the female housing A of the connector and that of the portion of the cam member, which has the opening 5, are flush with each other or not.

The present invention is not confined to the above-described embodiment and modification, but may be embodied or practiced in other various ways without departing from the spirit and scope of the invention.

What is claimed is:

1. An electrical connector comprising:

a male housing having a first terminal;

a female housing in which said male housing is movably disposed in a first direction so as to be fastened thereto, said female housing having a second terminal;

a cam member movably disposed on said female housing so that said cam member can be primarily in a second direction substantially transverse to said first direction in order to fasten said housings to each other, wherein said female housing includes a projecting portion extending outwardly from a side wall thereof facing a direction opposite said second direction and wherein an opposing side wall of said cam member has an opening therein for receiving said projecting portion when said housings have been completely fastened to each other.

2. An electrical connector according to claim 1, further comprising:

an inspection means provided on an outer surface of said cam member for detecting a positional relationship between said opening and said projection portion whether said male housing and said female housing are completely fastened to each other or not.

3. An electrical connector according to claim 2, further comprising: guide means provided on an outer surface of said member at mutually opposite edges of said opening so as to define a groove for positioning said inspection means.

* * * * *